US005234243A

United States Patent [19]

Howarth

[11] Patent Number: 5,234,243

[45] Date of Patent: Aug. 10, 1993

[54] TANK GAUGE FLOAT RETRIEVAL DEVICE

[75] Inventor: Dennis G. Howarth, Chester, Pa.

[73] Assignee: Atlantic Richfield Company, Los Angeles, Calif.

[21] Appl. No.: 854,160

[22] Filed: Mar. 20, 1992

[51] Int. Cl.[5] ..... B66C 1/00

[52] U.S. Cl. ..... 294/66.1; 294/81.56; 294/81.4

[58] Field of Search ..... 294/66.1, 67.31, 81.1, 294/81.4, 81.41, 81.51, 81.56, 81.61, 82.32; 414/625, 626

[56] References Cited

U.S. PATENT DOCUMENTS 3,208,789 9/1965 Barry ..... 294/81.61 X
3,210,113 10/1965 Tantlinger ..... 294/81.51
3,912,319 10/1975 Hamilton ..... 294/82.32 X
4,372,597 2/1983 Stillman et al. ..... 294/81.4
4,499,840 2/1985 Lung-Tung ..... 294/66.1 X
5,114,200 5/1992 Visnyouszky et al. ..... 294/81.56

*Primary Examiner*—David M. Mitchell
*Assistant Examiner*—Dean J. Kramer
*Attorney, Agent, or Firm*—Michael E. Martin

[57] ABSTRACT

Liquid storage tank level sensing gauge floats may be retrieved from within the tank without entry of personnel into the tank by a device comprising spaced apart pairs of pivotally-supported hook members which are engagable with guide arms or other support members of the float, upon lowering the device into the storage tank, whereby the float is grappled by the retrieval device for retrieval to the roof or top of the tank from outside the tank. The opposed pairs of hook members may be retained on a support rod by retaining collars which have slots for engagement with float guide rods or cables to further control the path of movement of the device during retrieval operations.

7 Claims, 1 Drawing Sheet

TANK GAUGE FLOAT RETRIEVAL DEVICE

BACKGROUND OF THE INVENTION

1. Field of the Invention

The present invention pertains to a retrieval device for retrieving a level sensing float of a level sensing gauge of the type used on liquid storage tanks.

2. Background

Certain types of level sensing gauges used in both fixed and transportable liquid storage tanks utilize a float which is attached to one end of a sensing tape or wire. The other end of the tape or wire is connected to the level sensing gauge, which is usually mounted on a hatch cover on the tank roof or top. One application of such types of level sensing gauges is on marine tankers. The common problem with this type of tank gauge is that the sensing tape or wire is subject to breakage, leaving the float to descend to the bottom of the tank as the liquid level also drops. Since these types of tanks are, when empty, filled with toxic vapors, the retrieval of the float for repair of the tank gauge is a serious problem. The present invention provides a solution to the problem.

SUMMARY OF THE INVENTION

The present invention provides a unique retrieval device for use in retrieving liquid level sensing gauge floats from storage tanks.

In accordance with an important aspect of the present invention, a float retrieval device is provided which may be lowered into a storage tank through a hatch or tank opening, which is normally occupied by the level sensing gauge, which device may be actuated to retrieve the level sensing float at a low elevation or at the bottom of the tank without requiring personnel to enter the tank.

In accordance with another important aspect of the present invention, there is provided a float retrieval device for a tank gauge float, which is selfactuating upon engaging the float support arms, to grapple the arms for retrieval from the bottom of the tank.

In accordance with yet a further aspect of the present invention, there is provided a tank gauge float retrieval device which is adapted to be connected to the float guide cables so that the device remains aligned with, and engagable, with the float regardless of its elevation in the tank.

Still further in accordance with the present invention, there is provided a unique float retrieval device for liquid storage tanks, such as marine tankers, which is convenient to use, mechanically uncomplicated and may be disposed in and retrieved from the storage tank without requiring entry of personnel into the tank or significant exposure of personnel to the vapors in the tank.

Those skilled in the art will recognize the above-described features and advantages of the present invention, together with other superior aspects thereof, upon reading the detailed description which follows in conjunction with the drawing.

DESCRIPTION OF A PREFERRED EMBODIMENT

Figure 1:
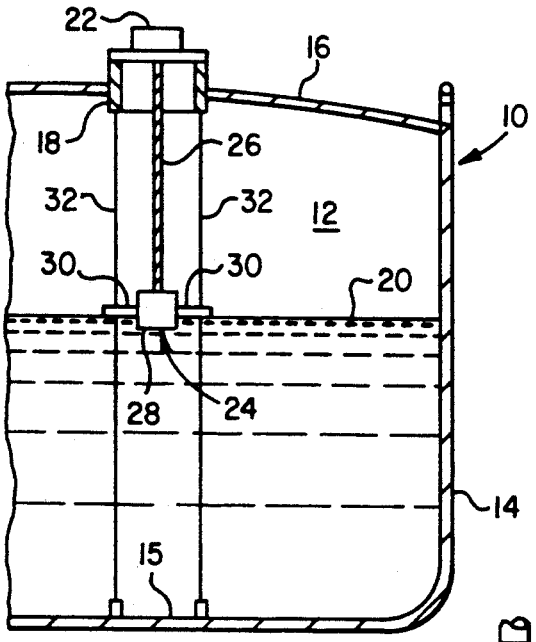
FIG. 1 (PRIOR ART)
FIG. 1 is a cross-section view of a portion of a marine tanker showing a level sensing gauge and float assembly.

In the description which follows, like parts are marked throughout the specification and drawing with the same reference numerals, respectively. The drawing figures are not necessarily to scale in the interest of clarity and conciseness.

Referring to FIG. 1, there is shown a portion of a liquid cargo tank of a marine tanker 10. The tank, generally designated by the numeral 12, is delimited by the tanker hull 14 and a roof or deck 16. A suitable hatch opening is delimited by a coaming 18, providing access to the interior of the tank 12. The level of liquid 20 in the tank 12 is sensed by a gauge 22, which is supported over the hatch coaming 18 and is connected to a float member 24 by a suitable, elongated, flexible tape or wire member 26. The float 24 includes a buoyant member 28 and opposed guide arms 30, which are guided by a pair of guide wires or cables 32 extending generally vertically between the hatch coaming 18 and the bottom 15 of the tank 12. Suitable openings are formed in each of the arms 30 through which the cables 32 extend. Accordingly, the float 24 is constrained to ride generally vertically within the tank 12 as the liquid level 20 varies and whereby the tape or wire 26 is paid out from or onto a suitable measuring reel, not shown, associated with the tank gauge 22.

From time to time, the tape or wire 26 is subject to breakage due to fatigue or due to sloshing of the liquid in the tank 12, for example. In such event, the float 24 becomes difficult to retrieve, particularly if the tank is not filled to a level whereby the float may be reached from the deck 16 through the hatch coaming 18. This is particularly true if the tank is emptied and the float 24 is sitting on the bottom 15. Entry of personnel into the interior of the tank 12 is usually forbidden or deemed particularly hazardous if the tank is used for toxic liquids, such as crude oil or refined petroleum products. Accordingly, there has been a long-sought need for a convenient device whereby the float 24 may be retrieved and connected to a new measuring tape or wire 26 when suitable repairs have been made to the tank gauge.

Figure 2:
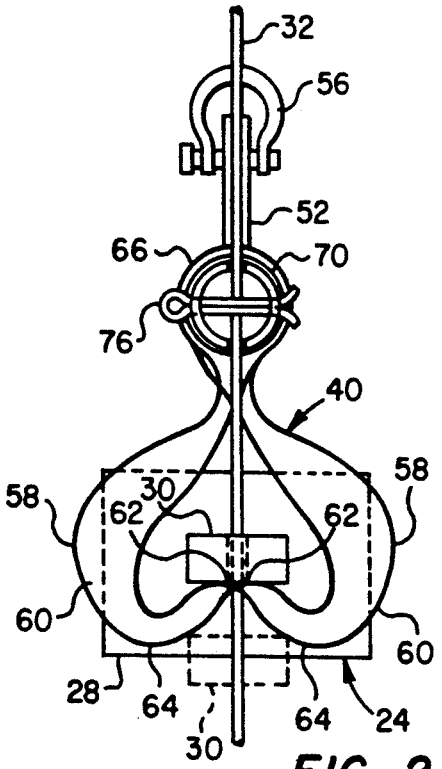
FIG. 2 is a side elevation of the retrieval device of the present invention.
Figure 3:
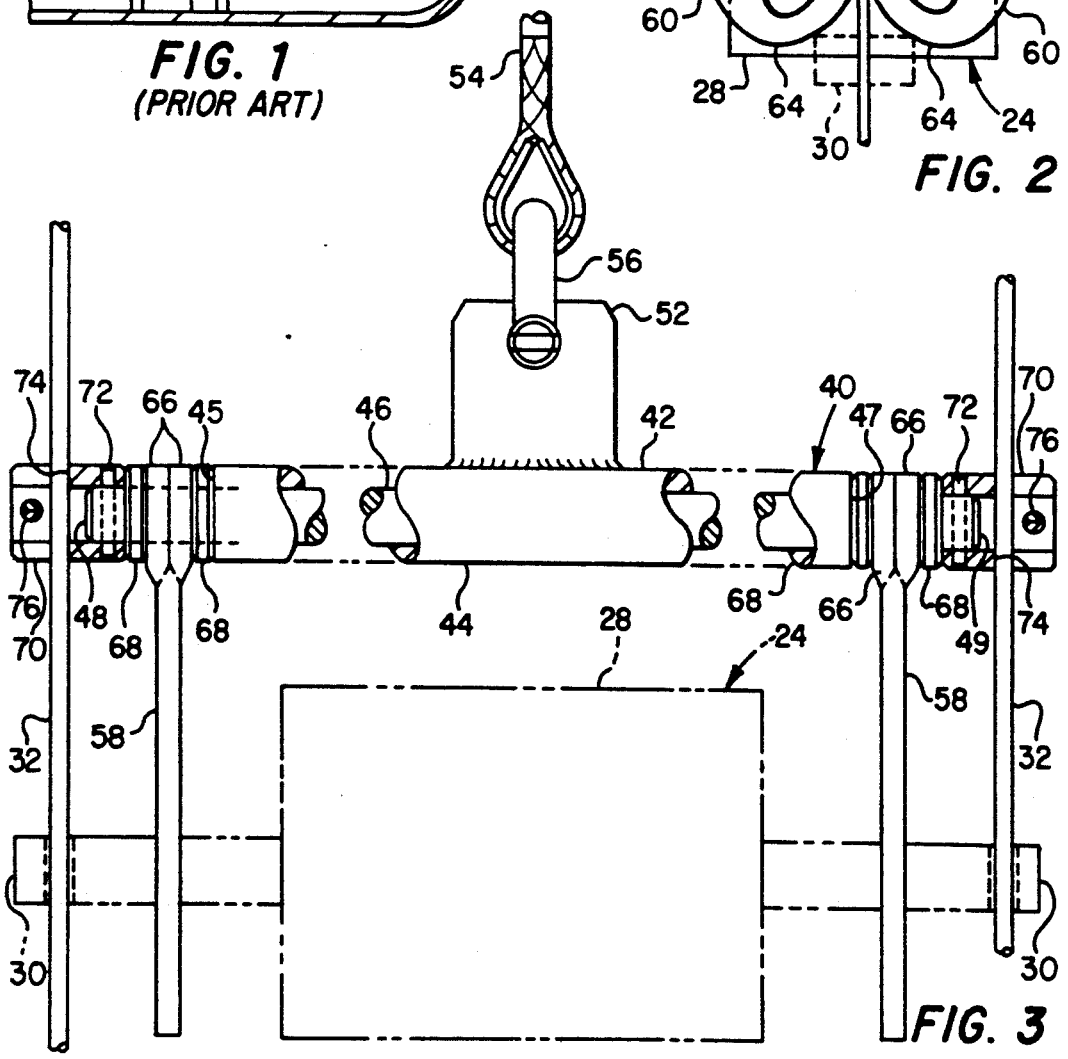
FIG. 3 is a front elevation of the retrieval device of the present invention.

Referring to FIGS. 2 and 3, the present invention provides such a device, generally designated by the numeral 40. The float retrieval device 40 includes a generally transversely extending support member 42, FIG. 3, characterized by a tubular sleeve 44 in which is journaled an elongated rod 46. The sleeve 44 is delimited by opposed transverse ends 45 and 47, and the rod 46 is delimited by opposed transverse ends 48 and 49 which extend beyond the ends 45 an 47, as illustrated in FIG. 3. The support member 42 is secured to an upstanding tang 52, which provides for connecting the device 40 to a flexible line 54 by way of conventional connecting means such as a shackle 56.

Each of the end portions of the rod 46 which extend beyond the ends 45 and 47 of the sleeve 44 are adapted to support pairs of opposed grapple hooks 58. Each of the hooks 58 is characterized by a curved body 60, FIG. 2, which has an upward-curved tip portion 62 and downward-facing cam surfaces 64. The hook bodies 60 also terminate at their upper ends in generally cylindrical bosses 66, see FIGS. 2 and 3, which are offset from the plane of the main portion of the hook bodies 60 so that the hook bodies may be aligned with each other. The bosses 66 are each provided with suitable bores to permit the hook members 58 to be supported on the opposed ends of the rod 46 in respective opposed pairs, as illustrated.

As shown in FIG. 3, the bosses 66 of the hooks 58 are journaled on the rod 46 between respective pairs of spacer bushings 68. The bushings 68, as well as the hook members 58, are retained on the rod 46 by opposed cylindrical tubular retainer collars 70. The collars 70 are retained on the respective ends 48 and 49 of the rod 46 by suitable retainer pins 72. The collars 70 each have a generally longitudinally extending slot 74 formed therein for receiving the guide cables 32, respectively. The opposite ends of the device 40 are retained in engagement with the guide cables 32 by removable retaining pins 76 comprising conventional cotter keys, for example, see FIG. 2. The retaining pins 76 extend through suitable openings formed in the distal ends of the collars 70, as illustrated.

The hook members 58 are pivotally journaled on the ends of the rod 46 so that they may pivot away from each other to engage and capture the arms 30 of the float 24, as illustrated in FIGS. 2 and 3. The hook members 58 are configured such that their cam surfaces 64, upon engagement of the arms 30, under the weight of the hook members and the device 40, itself, will move apart far enough to permit the arms 30 to move into the space or throat formed by and between each of the hook members 58 so that the arms will be retained in engagement with the hook members. Moreover, the hook members 58 are weighted and shaped in such a way that, when hanging free, they will pivot into engagement with each other, as illustrated in FIG. 2.

The operation of the device 40 will now be described briefly. In the event that the float 24 should become detached from the tape or wire 26, the tank gauge 22 is removed from the hatch coaming 18, providing access to the interior of the tank 12 at the deck 16. The device 40 is then inserted into the interior of the tank 12 through the hatch coaming 18 connected to its tether line 54, and the ends of the support members 42 as defined by the retaining collars 70, are positioned such that the guide cables 32 are inserted in the slots 74, respectively. Preferably, the retaining pins 76 are then inserted in the ends of the collars 70 to prevent inadvertent disengagement of the device 40 from the respective guide cables 32. The device 40 is then lowered into the tank 12 until the cam surfaces 64 of the hook members 58 engage the float guide arms 30. As previously described, the weight of the device 40 is such that a camming action will take place upon engagement of the arms 30 by the hook cam surfaces 64 sufficient to spread the hook members 58 of each pair apart to permit the tips 62 to clear the sides of the arms, and, once the arms are within the throat of the hook members, the hook members will be pivot back to their "closed " position, as shown in FIG. 2.

If there is any difficulty in causing the hook members 58 to spread apart, a rapid up and down movement of the device 40 by movement of the tether 54 will be sufficient to cause the hook members 58 to spread, upon engagement with the arms 30, a sufficient distance to permit the arms to enter the throat space between the hook members. Once at least one of the arms 30 has been fully engaged, and preferably both become engaged, the float 24 may be retrieved by pulling the device 40 back up toward the hatch coaming 18 so that it may be manually grasped once it reaches the vicinity of the deck 16.

Accordingly, the float 24 may be retrieved from virtually any position below the hatch coaming 18 within the interior of the tank 12, including the condition wherein the float 24 is resting on the bottom 15 of the tank. In this way, the float 24 may be easily retrieved without requiring entry of personnel into the tank interior, and all operations may be carried out from the deck 16.

The device 40 is preferably made of nonsparking metals such as naval bronze and the like. Other engineering materials suitable for tools used in the presence of volatile fluids may also be considered for construction of the device 40.

Although a preferred embodiment of the present invention has been described in detail herein, those skilled in the art will recognize that various substitutions and modifications may be made to the embodiment described without departing from the scope and spirit of the invention, as recited in the appended claims.

What is claimed is:

1. A retrieval device for retrieving a fluid level sensing float of a liquid storage tank, said float including a pair of opposed guide arms engaged with generally verticallyextending guide cables and a float member connected to said arms, said device comprising:

a support member; and spaced apart pairs of opposed hook members pivotally supported on said support member, said hook members each including a body, a tip portion and a cam surface formed thereon engageable with said guide arms of said float member in such a way that upon lowering said device from a point above said float member, said hook members engage said guide arms and pivot to a position to receive said guide arms in throat portions formed by each of said hook members to retain said guide arms for retrieval of said float member from the interior of said tank.

2. The device set forth in claim 1 wherein:

said support member comprises a generally tubular member having a support rod rotatably supported by and rotatable relative to said tubular member and means on said support member for connecting said device to a tether.

3. The device set forth in claim 2 wherein:

said tubular member includes opposed end portions, and said rod includes opposed end portions projecting from the end portions of said tubular member, respectively; and said opposed pairs of hook members are pivotally supported on said rod at respective opposite ends thereof.

4. The device set forth in claim 3, including:

retainer means on opposite ends of said support member, said retainer means including means for engaging said guide cables for guiding said device to move in a generally vertical direction to engage said float member.

5. The device set forth in claim 1 wherein:

said hook members each include a body portion which is weighted to urge said hook members to pivot toward each other.

6. A retrieval device for retrieving a fluid level sensing float of a liquid storage tank, said float including a pair of opposed guide arms engaged with generally vertically-extending guide cables and a float member connected to said arms, said device comprising:

a support member including a rod having opposed end portions; and spaced apart pairs of opposed hook members pivotally supported on said rod at respective opposite ends thereof and said hook members each including a body, a tip portion and a cam surface engageable with said guide arms of said float member in such a way that upon lowering said device from a point above said float member, said hook members of said pairs, respectively, are operable to move to engage and retain said guide arms between said hook members of said pairs for retrieval of said float member from the interior of said tank.

7. The device set forth in claim 6 including:

retainer means on opposite ends of said rod including means for engaging said guide cables for guiding said device to move to engage said float member.

* * * * *